United States Patent [19]

Inoue

[11] 4,339,933

[45] Jul. 20, 1982

[54] RACKING DEVICE FOR FLAT KNITTING MACHINE

[75] Inventor: Hideo Inoue, Wakayamashi, Japan

[73] Assignee: Shima Idea Center, Co., Ltd., Japan

[21] Appl. No.: 167,387

[22] Filed: Jul. 9, 1980

[30] Foreign Application Priority Data

Jul. 12, 1979 [JP] Japan ..... 54-88479

[51] Int. Cl.[3] ..... D04B 7/00; D04B 7/20

[52] U.S. Cl. ..... 66/69

[58] Field of Search ..... 66/69, 64

[56] References Cited

U.S. PATENT DOCUMENTS

| | | | |
|---|---|---|---|
| 1,571,765 | 2/1926 | Fels | 66/69 X |
| 2,284,167 | 5/1942 | Ralston | 66/69 |
| 3,477,254 | 11/1969 | Comas | 66/69 |

*Primary Examiner*—Ronald Feldbaum

*Attorney, Agent, or Firm*—Whittemore, Hulbert & Belknap

[57] ABSTRACT

A racking device for an automatic flat knitting machine in which a data of the knit structure and other data are stored in memory members in respect to each course and the knitting operation is carried out based on outputs of said stored data. The racking device includes a means for correcting a signal of an instruction for driving the racking motor.

2 Claims, 3 Drawing Figures

RACKING DEVICE FOR FLAT KNITTING MACHINE

BACKGROUND OF THE INVENTION

When a needle bed is racked by a racking device, the racking device is moved by 0.5 pitch, 1 pitch or a larger pitch. Since a yarn and a knitted fabric are caught on needles at this movement, the yarn pulls the needle in some knitted structure, and the needle is bent, with the result that even if the needle bed is moved by predetermined pitches, the needle is not shifted to the intended position and the actions of corresponding needles are inhibited. As means for overcoming this disadvantage, there has been proposed a method in which an adjusting piece is mounted on a cam for reciprocative movement of the needle bed and the quantity of displacement of the needle bed is adjusted according to the position of this adjusting piece. However, no satisfactory results can be obtained according to this method.

SUMMARY OF THE INVENTION

The present invention relates to a racking device in a flat knitting machine. More particularly, the present invention relates to a racking device of an automatic flat knitting machine in which data of the knit structure and other data are stored in memory members in respect to each course and the knitting operation is carried out based on outputs of said stored data. An object of the present invention is to eliminate the above-mentioned defect in the conventional racking device and is to provide a novel racking device in which the racking width is corrected and the needle bed is located at a position most suitable for a course when the needle bed is racked in a certain course.

The racking device of the present invention is characterized in that the rotation angle of a racking motor used for moving a needle bed is determined in advance according to the needle pitch, a plurality of correction values for correcting this predetermined rotation angle are preliminarily set in a racking-correcting zone and a signal of an instruction for driving the racking motor is corrected according to a signal based on one correction value selected among these correction values and stored in advance.

According to the racking device of the present invention, a plurality of correction value setting devices having correction values set in a plurality of stages are disposed in the racking-correcting zone and in the motor indexing control circuit, the instruction for driving the racking motor is corrected by the correction value from the racking-correcting zone according to the instruction of the memory member, and a racking correction value most suitable for the intended racking operation may be selected among a plurality of correction values and preliminarily stored.

DETAILED DESCRIPTION OF THE INVENTION

Figure 1:
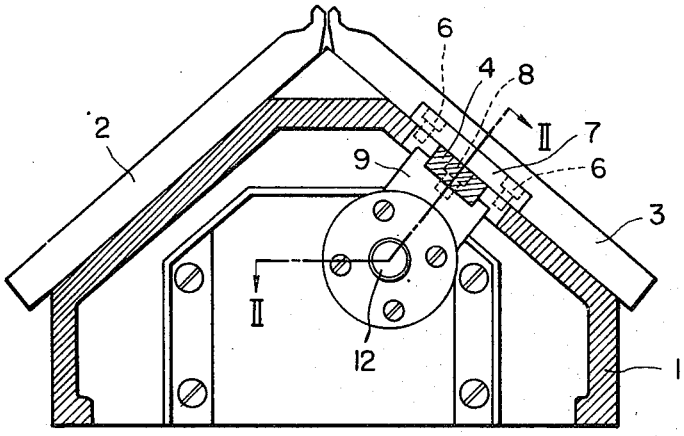
FIG. 1 is a longitudinally sectional side view of the body of the knitting machine.
Figure 2:
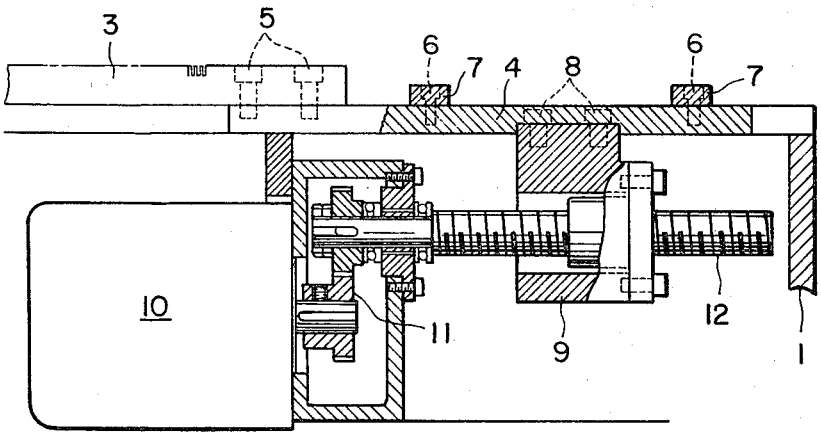
FIG. 2 is a view showing the section taken along the line II—II in FIG. 1.
Figure 3:
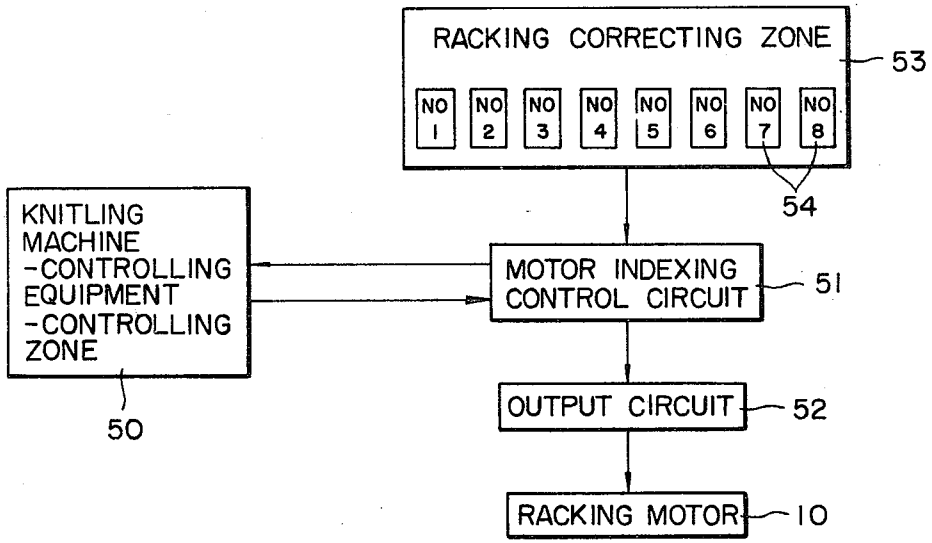
FIG. 3 is a block diagram illustrating the control circuit.

When a predetermined racking width corresponding to the needle pitch number is optionally increased or decreased to correct the racking width according to need and racking is carried out with the corrected racking width, a correction value of one of a plurality of correction value setting devices which are disposed in a racking width-correcting zone and in which correction values are set in advance, respectively, is selectively stored and signals of instructions for driving a racking motor are corrected in a motor indexing control circuit by a correction signal from the selected correction value setting device to rotate the racking motor in a predetermined manner.

An embodiment of the racking device of the present invention will now be described with reference to the accompanying drawings.

Reference numeral 1 represents a frame of the machine body, and a stationary needle bed 2 and a needle bed 3 slidable to the left and right are mounted on a mountain-shaped top portion of the frame 1. A connecting rod 4 is fixed to one end of the needle bed 3 by means of a bolt 5. The connecting rod 4 is slidably supported on the frame 1 by means of guides 7 fixed to the frame 1 by bolts 6. A feed nut 9 is secured to the connecting rod 4 by bolts 8. Reference numeral 10 represents a racking motor. The output of the racking motor 10 is transmitted to a feed screw 12 through a reduction gear 11. The feed nut 9 is engaged with the feed screw 12. If a pulse motor is used as the racking motor 10, the rotation angle of the motor can be controlled very easily.

In forming a knitted structure, knitting conditions for respective courses are storred in memory members such as tapes or pattern cards. If racking is necessary for formation of the knitted structure, the course where racking is to be done and the racking pitch number are stored. The rotation of the racking motor 10 is transmitted to the feed screw 12 through the reduction gear 11, and by rotation of the feed screw 12, the feed nut 9 is shifted in the axial direction of the screw 12, with the result that the connecting rod 4 and needle bed 3 integrated with the feed nut 9 are moved laterally. Accordingly, the lateral movement of the needle bed 3 is determined by the quantity of rotation of the racking motor 10. Accordingly, the quantity of rotation of the racking motor 10, that is, the pitch number of needles necessary for this rotation, is stored in the memory member such as the above-mentioned tape or pattern card. If the racking motor 10 is a pulse motor, the number of pulses necessary for racking the needle by necessary pitches is stored in the memory member. Of course, if it is apprehended that because of the knit structure in said course or the size of the yarn, the needle caught by the knitted texture is bent at the time of racking and only by the movement of the needle bed corresponding to the needle pitch, the racked needle fails to confront precisely the corresponding needle, the needle bed must be additionally moved so as to eliminate this disagreement. Values for this correction are stored in the memory members at the time when the rotation angle of the racking motor 10 is stored.

Stepwise correction values of +1, +2, +3 and +4 are set to cover several pulse or a certain rotation angle. Of course, minus correction values are similarly set.

These collection values of +1 to +4 and −1 to −4 are designated as correction values Nos. 1 to 8 respectively. A specific correction value is determined for each racking motion and the so determined correction values are stored in the memory members.

In the knitting operation, the memory members are retrieved in a zone 50 for controlling a knitting machine-controlling equipment, and if the instruction for driving the racking motor or the instruction for correcting the driving of the racking motor is stored, a signal based on detection of this memory is put in a motor indexing control circuit 51. The signal put in this control circuit 51 is amplified in an output circuit 52 to close the contact of the racking motor 10 and rotate the racking motor 10 by the predetermined number of pulses or by the predetermined rotation angle. If the instruction for correcting the driving of the racking motor, for example, the instruction for performing the correction of the correction value No. 1, is stored in the memory member, a signal of the correction instruction is put in the motor indexing control circuit 51 as well as the above-mentioned signal of the driving instruction. If this correction signal is put in the control circuit 51, the control circuit 51 selectively receives a signal from a correction value setting device No. 1 of setting devices 54 in a racking-correction zone 53, which emits the correction value of +1, and the instruction for driving the racking motor is corrected by this signal. The corrected signal is put in the output signal 52 and amplified by the output circuit 52 and the racking motor 10 is rotated according to the amplified signal in the same manner as described above.

When corrections of 8 stages, that is, corrections of correction values of +1 to +4 and −1 to −4, are made in the racking-correcting zone 53, eight kinds of correction value setting devices 54, that is, setting devices Nos. 1 to 8, are disposed so that corrections of +1 to +4 and −1 to −4 are performed by these eight correction value setting devices 54, respectively. For example, if correction of +1 is necessary, by the output from the correction value setting device No. 1 of the setting devices 54 in the racking-correcting zone 53, the signal of the instruction for driving the racking motor is corrected and the corrected signal is put out from the motor indexing control circuit 51.

The motor indexing circuit 51 feeds back its output to the zone 50 for controlling the knitting machine-controlling equipment to confirm that the predetermined rotation is given to the racking motor.

As will be apparent from the foregoing illustration, in the racking device of the present invention, a racking correction value most suitable for the intended racking operation is selected among a plurality of correction values and preliminarily stored, and when the needle bed is racked in a certain course, the racking width is corrected and the needle bed is located at a position most suitable for this course.

What is claimed is:

1. A racking device for a flat knitting machine, which comprises a needle bed slidably mounted on a frame of the machine body and moving in the lateral direction according to a rotation angle of a racking motor, a zone for controlling a knitting machine-controlling equipment for detecting memories which are stored in memory members, a racking-correcting zone which has a plurality of correction value setting devices for racking, in which different correction values are set respectively, a motor indexing control circuit in which signals of the instructions of the knitting machine-controlling equipment-controlling zone for driving the racking motor and correcting the driving of the racking motor are put and which corrects the signals of the instructions for driving the racking motor according to the signal of the instructions for correcting the driving of the racking motor based on the correction value of the correction value setting device corresponding to said signals of the instructions for correcting the driving of the racking motor, an output circuit for amplifying the output of said motor indexing control circuit, and a racking motor having a power source circuit which is put on by the output of the output circuit.

2. A racking device for a flat knitting machine as claimed in claim 1, wherein said memories stored in the zone for controlling a knitting machine-controlling equipment are such as instructions for driving the racking motor and instructions for correcting the driving of the racking motor and they are stored in memory members such as tapes or punch cards.

* * * * *